US008247722B2

(12) United States Patent
Ominato

(10) Patent No.: US 8,247,722 B2
(45) Date of Patent: Aug. 21, 2012

(54) ILLUMINATED PUSH BUTTON SWITCH

(75) Inventor: Hiroyuki Ominato, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 244 days.

(21) Appl. No.: 12/662,282

(22) Filed: Apr. 8, 2010

(65) Prior Publication Data

US 2010/0314229 A1 Dec. 16, 2010

(30) Foreign Application Priority Data

Jun. 10, 2009 (JP) ..... 2009-139105

(51) Int. Cl.
*H01H 9/00* (2006.01)

(52) U.S. Cl. ..... 200/314

(58) Field of Classification Search ..... 200/314, 200/310

See application file for complete search history.

(56) References Cited

U.S. PATENT DOCUMENTS 7,458,713 B2 12/2008 Onishi

FOREIGN PATENT DOCUMENTS

| | | |
|---|---|---|
| JP | A-2-306510 | 12/1990 |
| JP | A-7-284587 | 10/1995 |
| JP | A-8-112479 | 5/1996 |
| JP | A-9-22634 | 1/1997 |
| JP | A-9-102235 | 4/1997 |
| JP | A-9-306277 | 11/1997 |
| JP | A-2002-253887 | 9/2002 |
| JP | A-2006-147498 | 6/2006 |
| JP | A-2006-164530 | 6/2006 |
| JP | A-2007-134080 | 5/2007 |
| JP | A-2008-94201 | 4/2008 |
| JP | A-2009-26576 | 2/2009 |
| JP | A-2009-123662 | 6/2009 |
| WO | WO 2008/044415 A1 | 4/2008 |

OTHER PUBLICATIONS

Notification of Reasons for Refusal dated Apr. 12, 2011 in corresponding Japanese Patent Application 2009-139105.

Notification of Reasons for Refusal dated Jun. 9, 2011 in Japanese Patent Application No. 2009-139105.

*Primary Examiner* — Vanessa Girardi

(74) *Attorney, Agent, or Firm* — Oliff & Berridge, PLC

(57) ABSTRACT

A push button switch device includes a push button disposed on a cover constituting an outer surface of an equipment body and light-transmissible, a switching element behind the push button so that its operation axis substantially corresponds with a central axis of the push button, light sources around the switching element to illuminate the push button and operated by the push button, and an incidence surface on a rear surface of the push button so that light from the light sources is incident on it and including a concave curved surface located so as to face the light sources and a convex curved surface located outside and continuous to the concave curved surface. The push button has a recess in a central rear surface so as to be located inside the incidence surface and a light scattering surface on an inner surface of the recess so as to scatter light.

8 Claims, 14 Drawing Sheets

ILLUMINATED PUSH BUTTON SWITCH

CROSS-REFERENCE TO RELATED APPLICATIONS

This application is based on and claims the benefit of priority from the prior Japanese Patent Application No. 2009-139105, filed on Jun. 10, 2009, the entire contents of which are incorporated herein by reference.

BACKGROUND

1. Field

The present disclosure relates to a push button switch device including a self-illumination push button member, and a sewing machine provided therewith.

2. Related Art

A household sewing machine includes a push button switch device, such as a start/stop switch, provided on the front of an arm constituting a sewing machine body, for example. The push button switch device of the aforementioned type comprises a push button member which is mounted on a cover constituting the front of the arm so as to be depressible. With this, a switching element such as a "tact switch" (a registered trademark) is mounted on a substrate provided inside the cover, so as to be actuated by the push button member.

A self-illumination push button switch device is also provided which can display an operated state thereof (on or off state) in such a manner that a user can easily recognize the state of the switch. The self-illumination push button switch device includes a push button member made of a translucent material and light sources provided at a rear surface side of the push button member. For example, when the switch is in an on state, the whole surface, an outer peripheral ring, a mark and characters both provided on the surface or background is illuminated by light from the rear side.

A first conventional self-illumination push button switch device includes a cylindrical cap-shaped push button member, a light-emitting diode which is mounted on a substrate at the rear side of the push button member so as to correspond to a central part of the push button member, and a switching element is provided at a decentered position on a periphery of the push button member.

A second conventional self-illumination push button switch device includes a circular push button member made of a light-transmissive resin, a switch element provided along the central axis on a rear surface of the push button member, and plural light sources (LEDs) provided at respective positions displaced from a central axis of the switching element.

A third conventional self-illumination push button switch device includes a push button member made of a light-transmissive resin, a switching element and light-emitting elements serving as light sources. A mask member is provided on a rear surface of the push button member to guide light from the light-emitting elements to a predetermined position on the push button member.

The above-described first to third conventional switch devices have the following disadvantages. Since the switching element is decentered with respect to the push button member in the first conventional switch, a central axis of the push button member does not correspond with an operation axis of the switch element. As a result, the first switch device has a low operability, for example, providing a bad operation feeling when the user depresses the push button member.

The second switch device provides a good operation feeling since a central axis of the push button member substantially corresponds with an operation axis of the switching element. However, this necessitates locating the light sources (LEDs) at the respective positions displaced from the central axis of the switching element. Accordingly, it is difficult to uniformly illuminate the whole surface of the push button member. As a result, for example, the central part of the push button member is darker than the peripheral part of the push button member. Thus, the second switch device lacks in uniformity of brightness, resulting in a defect of low visual effect.

The third switch device includes the push button member having a good operation feeling and the mask member which can guide the light from the light-emitting elements to a necessary position on the push button. As a result, variations in the brightness can be reduced. However, provision of the mask member increases the number of components and complicates the structure of the switch device.

Thus, each of the above-mentioned conventional push button switch devices has an advantage and a drawback. Consequently, a push button switch device has been desired which has a good operation feeling, can uniformly illuminate the whole surface of the push button member, and can achieve these features by a simpler structure.

SUMMARY

Therefore, an object of the present disclosure is to provide a push button switch device which can provide a good operation feeling and can uniformly illuminate the surface of the push button member by employment of a simpler structure.

The present disclosure provides a push button switch device which is provided on an equipment body, comprising a push button member which is disposed on a cover constituting an outer surface of the equipment body so as to be depressible, the push button member being configured to be light-transmissible and having an outer surface and a rear surface; a switching element provided behind the push button member so that an operation axis thereof substantially corresponds with a central axis of the push button member; a plurality of light sources which is disposed around the switching element to illuminate the outer surface of the push button member, the light sources being operated by the push button member; and an incidence surface which is provided on the rear surface of the push button member so that light from the light sources is incident thereon, the incidence surface including a concave curved surface that is located so as to substantially face the light sources and a convex curved surface that is located outside the concave curved surface and is continuous to the concave curved surface, wherein the push button member has a recess which is formed in a central rear surface so as to be located inside the incidence surface and a light scattering surface which is provided on an inner surface of the recess so as to scatter light.

The present disclosure also provides a sewing machine comprising a sewing machine body; and a push button switch device provided on the sewing machine body and including a push button member which is disposed on a cover constituting an outer surface of the equipment body so as to be depressible, the push button member being configured to be light-transmissible and having an outer surface and a rear surface; a switching element provided behind the push button member so that an operation axis thereof substantially corresponds with a central axis of the push button member; a plurality of light sources which is disposed around the switching element to illuminate the outer surface of the push button member, the light sources being operated by the push button member; and an incidence surface which is provided on the rear surface of the push button member so that light from the light sources is incident thereon, the incidence surface including a concave curved surface that is located so as to substantially face the light sources and a convex curved surface that is located outside the concave curved surface and is continuous to the concave curved surface.

DETAILED DESCRIPTION

First Example

A first example will be described with reference to FIGS. 1 to 7. The push button switch device is employed in a household sewing machine in the first example.

Figure 1:
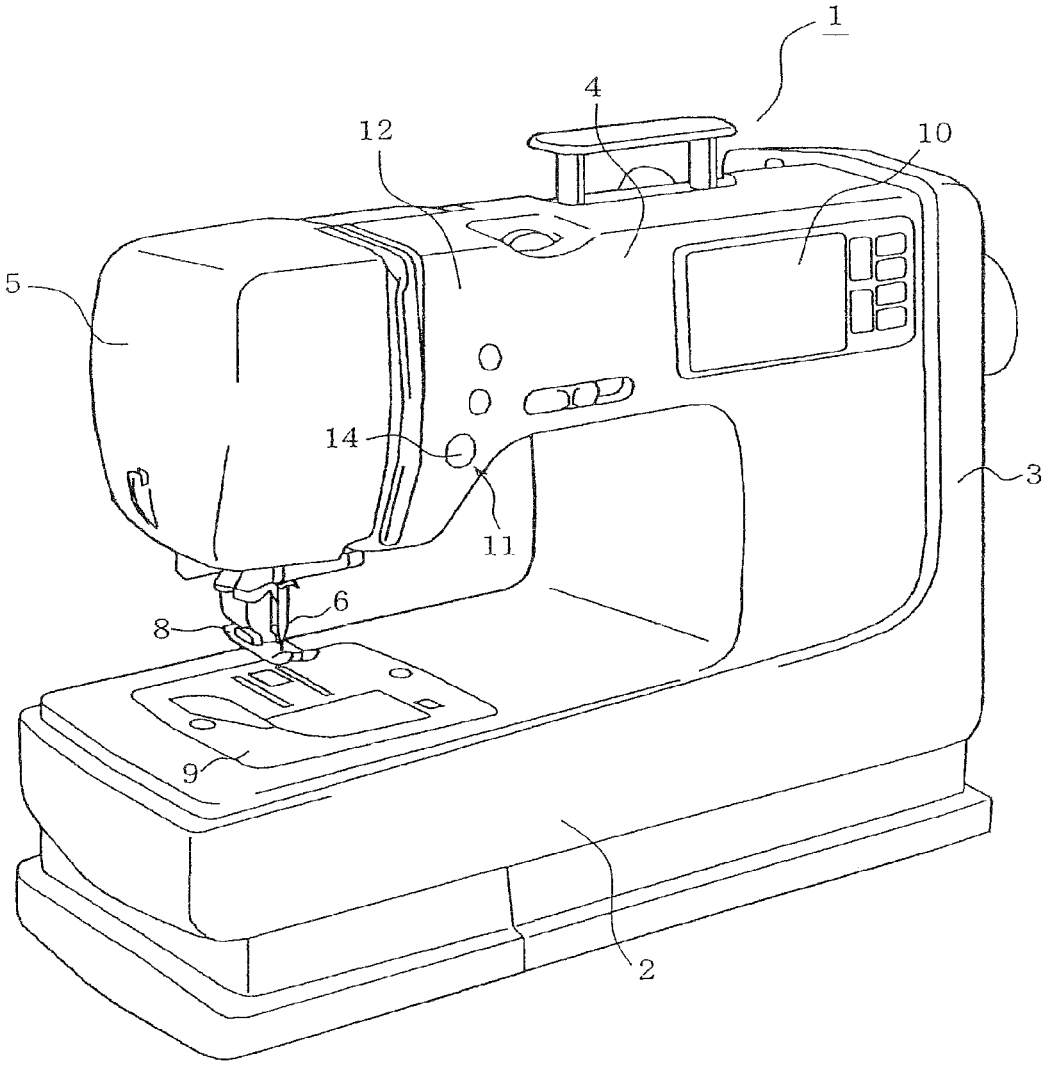
FIG. 1 is a perspective view of a sewing machine body which is provided with a push button switch of a first example.

Firstly, a body 1 of the household sewing machine serves as an equipment body and will be described with reference to FIG. 1. The sewing machine body 1 includes a bed 2 extending in the right-left direction in FIG. 1, a pillar 3 standing on a right end of the bed 2, and an arm 4 extending leftward from an upper end of the pillar 3 in FIG. 1. The bed 2, pillar 3 and arm 4 are formed integrally with the sewing machine body 1. The arm 4 has a distal end serving as a sewing machine head 5. The head 5 is provided with a needle bar (not shown) movable upward and downward. A needle 6 is attached to a distal (or lower) end of the needle bar. A presser foot 8 is also mounted on the needle bar. A drive mechanism is provided in the sewing machine body 1 to drive the needle bar and the like. A sewing machine motor (not shown) serves as a driving source of the drive mechanism.

A needle plate 9 is mounted on an upper surface of the bed 2, and a feed dog (not shown) is mounted on the needle plate 9 to feed a workpiece cloth (not shown). In the bed 2 are provided a rotary hook which forms stitches in cooperation with the needle 6, a feed dog driving mechanism which drives the feed dog, and the like although not shown. The rotary hook and the feed dog driving mechanism and the like are located below the needle plate 9. A driving force of the sewing machine motor is transmitted to the rotary hook, the feed dog driving mechanism and the like so that the rotary hook, the feed dog driving mechanism and the like are driven in synchronization with the upward and downward movement of the needle bar. The arm 4 includes a front on which are provided a liquid crystal display 10 having a touch panel and various operation switches including a start/stop switch 11 which is operated by the user so that a sewing operation is started or stopped. The start/stop switch 11 serves as a push button switch device and will hereinafter be referred to as "push button switch device 11." For example, a plastic cover 12 constitutes an outer surface (a front wall) of the arm 4. The push button switch device 11 is mounted on the cover 12.

Figure 2A:
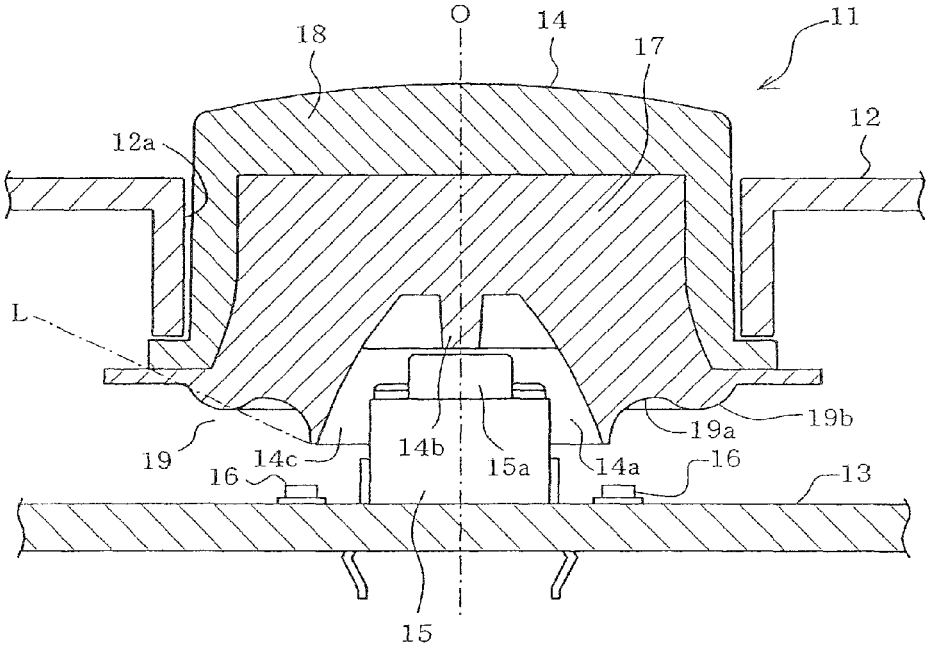
FIG. 2A is a longitudinal front section of the push button switch device.
Figure 2B:
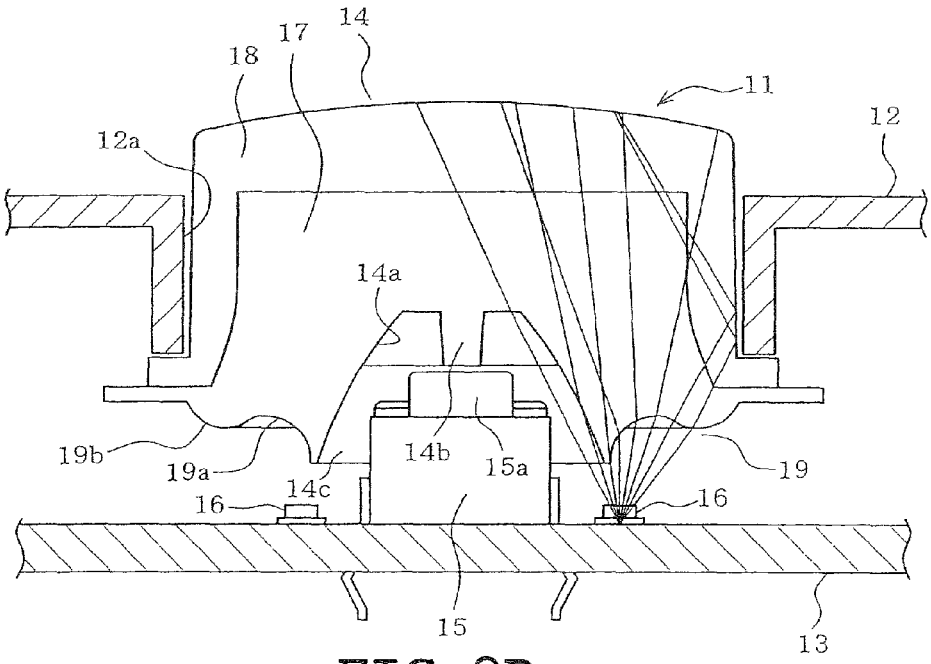
FIG. 2B is a longitudinal front section of the push button switch device, showing light emitted from LED to be incident on a push button member.

The push button switch device 11 of the first example will be described in detail with reference to FIGS. 2A to 7. The push button switch device 11 as shown in each of FIGS. 2A to 7 is taken from a different angle from in FIG. 1. More specifically, the view of the push button switch 11 in each of FIGS. 2A to 7 differs from that in FIG. 1 by the angle of 90 degrees. In other words, the push button switch device 11 is shown in each of FIGS. 2A to 7 while the front of cover 12 is directed upward (or the inside of the cover 12 is directed downward). Accordingly, the push button switch device 11 is depressed in the up-down direction in each of FIGS. 2A to 7 although depressed in the front-rear direction actually. The following description is based on the state of the push button switch device 11 as shown in each of FIGS. 2A to 7. Thus, FIGS. 2A and 2B are regarded as longitudinal front sectional views of the push button switch device 11.

The push button switch device 11 includes a push button member 14 operated by the user, a switching element 15 actuated by the push button member 14 and plural light sources which illuminate the push button member 14. Four light-emitting diodes (LEDs) 16 such as green LEDs are employed as the light sources. As shown in FIGS. 2A to 4, the circuit board 13 is disposed at the side of an inner surface of the cover 12, and the switching element 15 and the four LEDs 16 are mounted on the circuit board 13 so as to be disposed substantially in parallel to one another at predetermined intervals. The circuit board 13 is fixed to the cover 12 by a plurality of screws (not shown).

The push button member 14 is generally formed into the shape of a shallow hat and has a retaining flange formed on an outer circumference thereof as shown in FIGS. 2A, 2B, 3 and 5. The push button member 14 is located in a circular opening 12*a* formed in the cover 4 and supported by the cover 12 so as to be vertically movable by a predetermined stroke, as shown in FIG. 2. More concretely, the push button member 14 comprises two members or a transparent member 17 and a cap member 18, and the shape, material thereof and the like will be described later.

Figure 3:
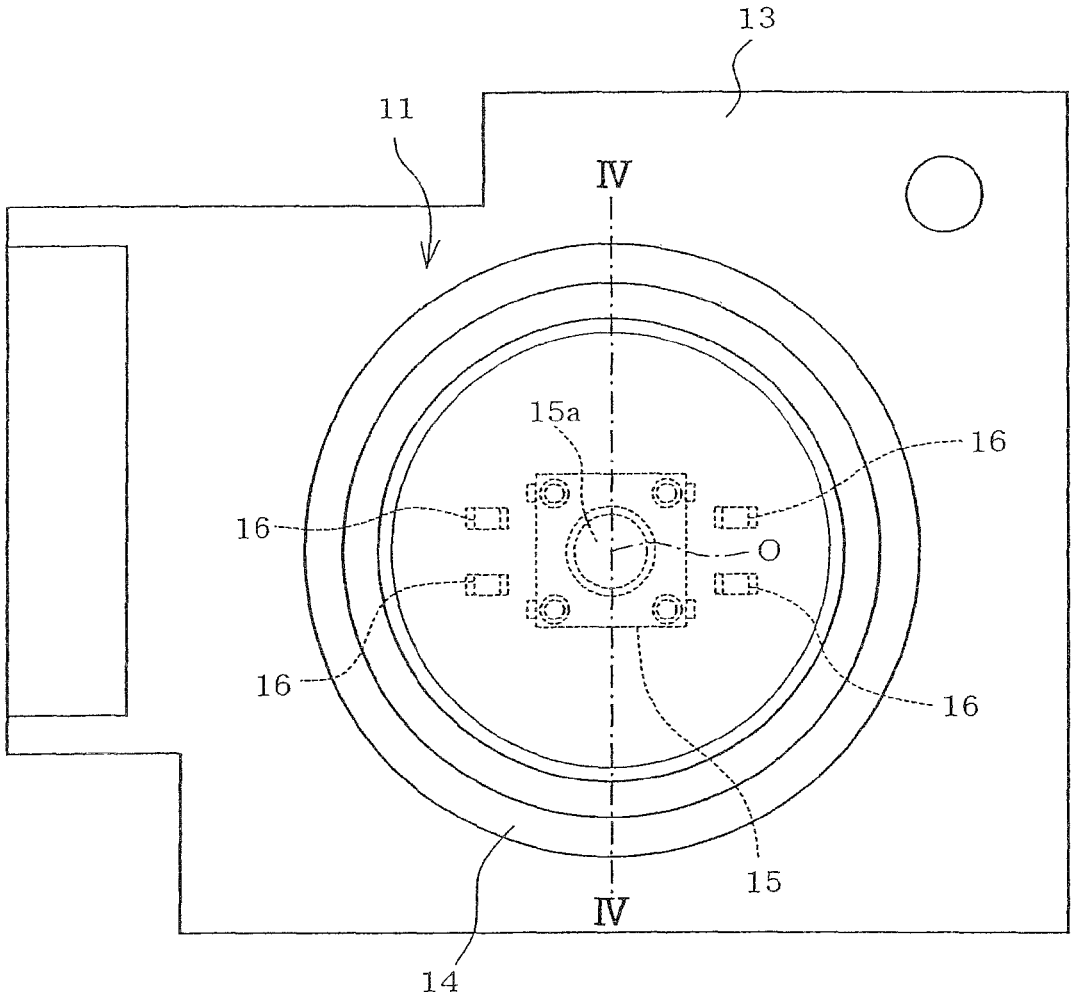
FIG. 3 is a plan view of the push button switch device with a cover being eliminated.
Figure 4:
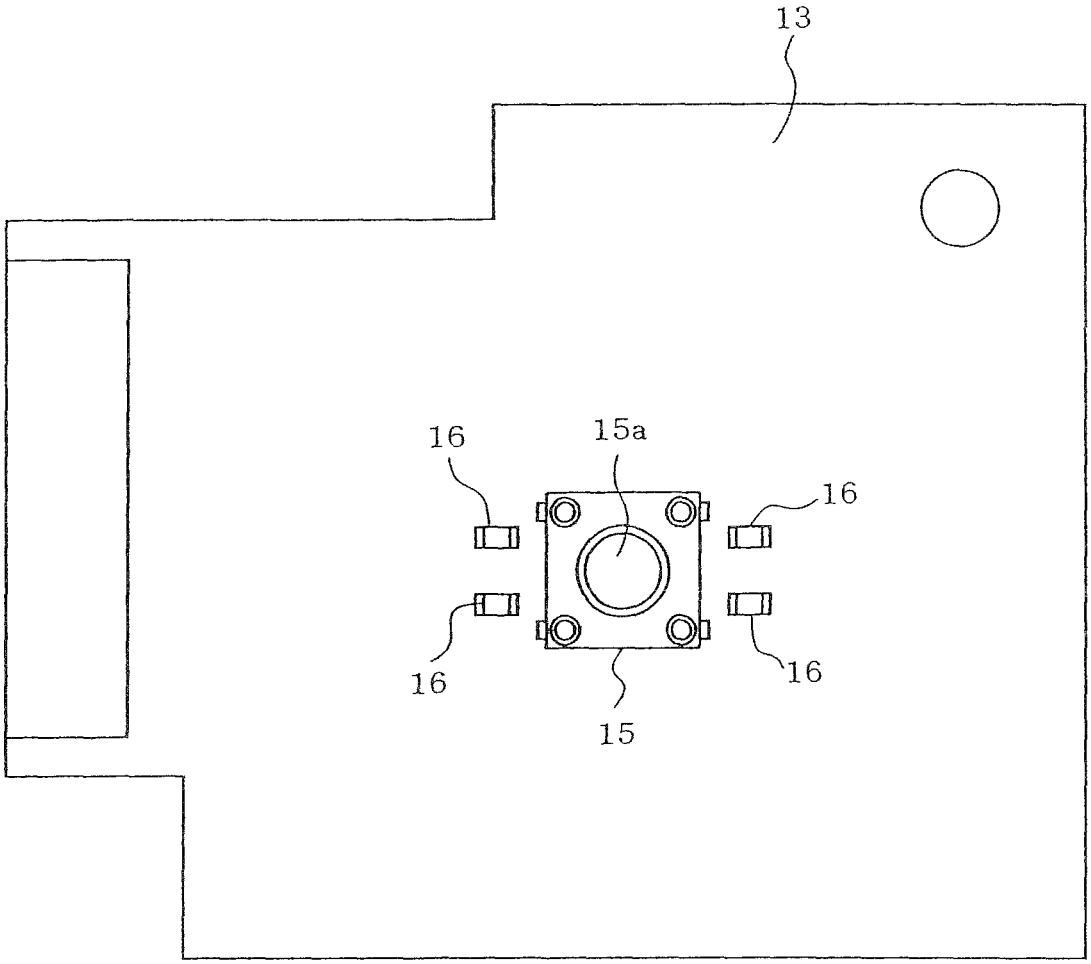
FIG. 4 is a plan view of a circuit board employed with the push button switch device.

The switching element 15 comprises a tact switch (registered trademark) and has an operating portion 15*a* protruding from a central upper surface thereof as shown in FIGS. 2A to 4. The switching element 15 is switched to the on or off state every time the operating portion 15*a* is depressed. The switching element 15 is disposed on the circuit board 13 so that the operation axis (the center of the operating portion 15*a*) corresponds with a central axis O of the push button member 14, as shown in FIGS. 2A to 3. An operation signal delivered by the switching element 15 is supplied into a control circuit which comprises a computer (not shown) and controls the whole sewing machine.

The two LEDs 16 are mounted on the circuit board 13 so as to be located near the right side of the switching element 15, and the other two LEDs 16 are mounted on the circuit board 13 so as to be located near the left of the switching element 15, as shown in FIGS. 2A to 4. Each pair of switching elements 15 are arranged back and forth and directed upward. The LEDs 16 are controlled by the aforesaid control circuit so as to be turned on and off. In this case, the LEDs 16 are turned on when the switching element 15 is in the on-state, and the LEDs 16 are turned off when the switching element 15 is in the off-state.

Figure 6:
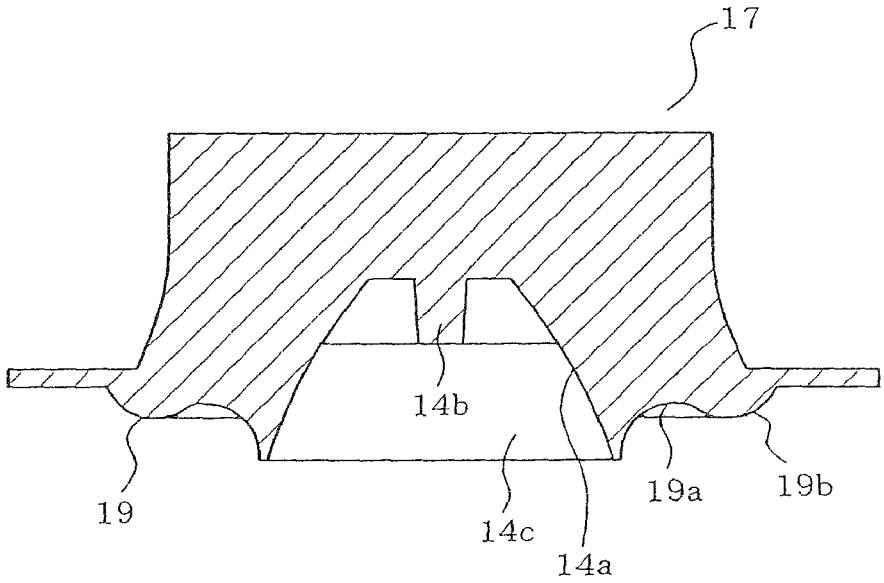
FIG. 6 is a longitudinal section of a transparent member taken along line VI-VI in FIG. 3.
Figure 7:
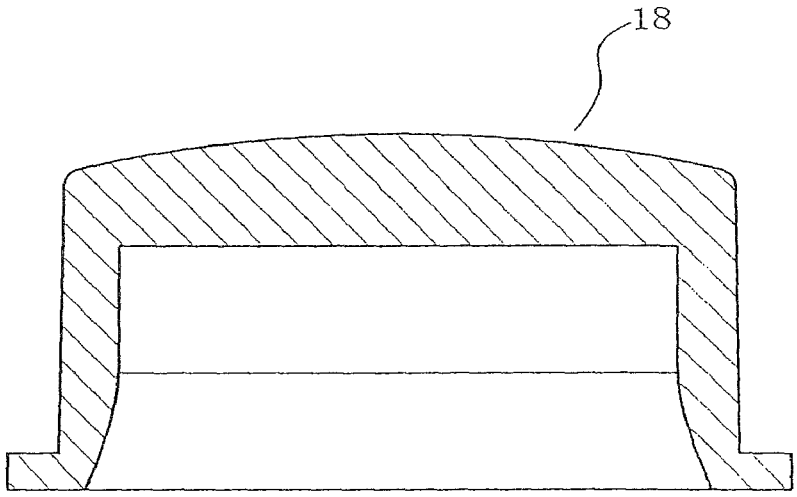
FIG. 7 is a longitudinal front section of a cap.

The push button member 14 will now be described in detail. As shown in FIGS. 2A and 2B, the push button member 14 comprises the transparent member 17 and the cap member 18 joined to each other (for example, by bonding) and is formed into the shape of a shallow hat, as described above. The transparent member 17 comprises a transparent plastic molding made from a material such as acrylic or polycarbonate and is shaped so as to fill the inside of the push button member 14 as also shown in FIG. 6. On the other hand, the cap member 18 comprises an opalescent plastic molding made from a material such as acrylic or polycarbonate and is formed into the shape of a cylindrical cap closely adherent to (covering) an upper surface and an outer circumferential surface of the transparent member 17 as shown in FIGS. 2A, 2B and 7. In this case, the cap member 18 made from the opalescent material serves as a light scattering member which scatters light through the transparent member 17 inside the cap member 18. The transparent member 17 and the cap member 18 may be joined together by a two-color molding, an insert molding or the like other than by bonding.

Figure 5:
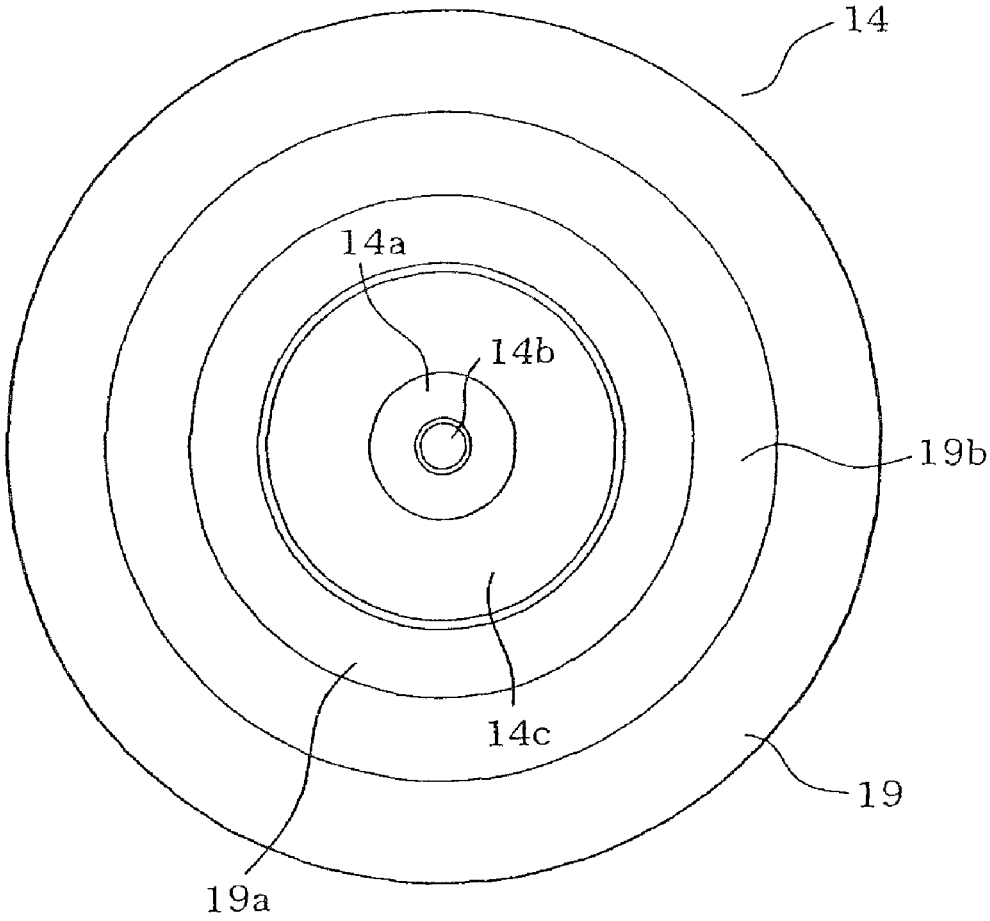
FIG. 5 is a bottom view of the push button member.

The push button member 14 has a recess 14*a* which is formed in a central rear surface thereof (or of the transparent member 17) so as to cover an upper end of the switching element 15 as shown in FIGS. 2A, 2B, 5 and 6. A push rod 14*b* is also formed integrally with the recess 14*a* so as to protrude downward from the central bottom of the recess 14*a*. The push rod 14*b* protrudes along a central axis line O of the push button member 14 to operate the operating portion 15*a* of the switching element 15. In this case, the recess 14*a* is formed into such a circular tapered shape that an inner surface thereof is gradually narrowed upwards, as shown in FIGS. 5 and 6. A lower half of the inner circumferential surface of the recess 14*a* has a number of convexities and concavities formed by surface texturing. The inner circumferential surface processed by the surface texturing serves as a light scattering surface 14*c* which scatters light.

The rear surface of the push button member 14 (or of the transparent member 17) includes a part outside the recess 14*a* (between the recess 14*a* and the flange) serving as an incidence surface 19 formed so that light from the LEDs 16 is incident on the transparent member 17. The incidence surface 19 is formed with a concave curved surface 19*a* that is located so as to substantially face the LEDs 16 as shown in FIGS. 2A, 2B, 5 and 6. The concave curved surface 19*a* is formed so as to have an arc-shaped (arcuate) section extending along a radial direction. The incidence surface 19 also has a convex curved surface 19*b* located outside the concave curved surface 19*a* and is continuous to the concave curved surface 19*a*. The convex curved surface 19*b* has a curvature reverse to the concave curved surface 19*a* and is formed so as to have an arc-shaped (arcuate) section extending along the radial direction. Additionally, in the first example, the incidence surface 19 is formed into such an inclined surface that the incidence surface 19 is generally spaced farther upwardly away from the light sources as the incidence surface 19 goes outward (toward the outer circumference from the central part).

The above-described push button switch device 11 will work as follows. When the user depresses the push button member 14 of the push button switch device 11, the push rod 14*b* actuates the operating portion 15*a* of the switching element 15, whereby start or stop of a sewing operation by the sewing machine body 1 can be instructed. In this case, since the operation axis substantially corresponds with the central axis of the push button member 14, a good operational feeling can be obtained when the user depresses the push button member 14.

The LEDs 16 provided at the side of the rear of the push button member 14 (the circuit board 13) are turned on when the switching element 15 is turned on. Light emitted from the LEDs 16 impinges through the transparent member 17 onto the surface of the push button member 14 (the upper surface of the cap member 18), thereby illuminating the whole surface of the push button member 14. Accordingly, an operating state (an on-off state of the switching element 15) of the push button member 14 can be displayed for the user to be able to understand easily. In this case, the light passes through the transparent member 17, reaching the cap member 18. Since the light scatters inside the opalescent cap member 18, the user can view the push button member 14 illuminated brightly from all angles.

If the LEDs 16 are located around the switching element 15 or displaced from the center of the push button member 14, a central surface of the push button member 14 would be darker than the other part. That is, there is a possibility of nonuniformity in the brightness. In the example, however, the nonuniformity in the brightness can be overcome by an improvement in the configuration of the incidence surface 19 of the push button member 14, and the like. More specifically, paths of light emitted from one of the LEDs 16 are shown in FIG. 2B. The incidence surface 19 is provided with a concave curved surface 19*a* that is located so as to substantially face the LED 16. As a result, light incident on the concave curved surface 19*a* can be scattered onto the whole push button member 14 (the transparent member 17). The incidence surface 19 is also provided with a convex curved surface 19*b* located outside the concave curved surface 19*a*, which can refract the light incident thereon in such a direction that the light goes to the central part of the push button member 14. Moreover, the incidence surface 19 as a whole is formed into such an inclined surface as to be spaced upwardly farther away from the light sources as the incidence surface 19 goes to the outer part thereof. As a result, light incident on the incidence surface 19 can be refracted toward the central region. Accordingly, the light incident on the incidence surface 19 can be concentrated on the central region of the push button member 14 where the brightness tends to be reduced.

Still furthermore, part of the light emitted from the LEDs 16 passes through the recess 14*a* but not through the incidence surface 19, thereby being incident on the transparent member 17. In this case, the light scattering surface 14*c* is provided on the inner surface of the recess 14*a*. This can suppress an unintended total reflection of light on the inner surface of the recess 14*a*, whereupon a reduction in the brightness can be suppressed in the central surface region of the push button member 14. Thus, the nonuniformity in the brightness on the surface of the push button member 14 can be suppressed and the whole surface can be illuminated uniformly.

According to the above-described example, the push button member 14 can provide a good operation feeling. And the nonuniformity in the brightness of the surface of the push button member 14 can be overcome by the improvement in the configuration of the incidence surface 19 of the push button member 14, and the like without increase in the number of components. Thus, the surface of the push button member 14 can be illuminated uniformly.

Second, Third and Other Examples

FIGS. 8A to 12 illustrate a push button switch 21 as a second example. In each of the following second and third examples, the push button switch device is also applied to the sewing machine, and identical or similar parts are labeled by the same reference symbols as those in the first example. The description of these identical parts will be eliminated and only the difference from the first example will be described.

Figure 8A:
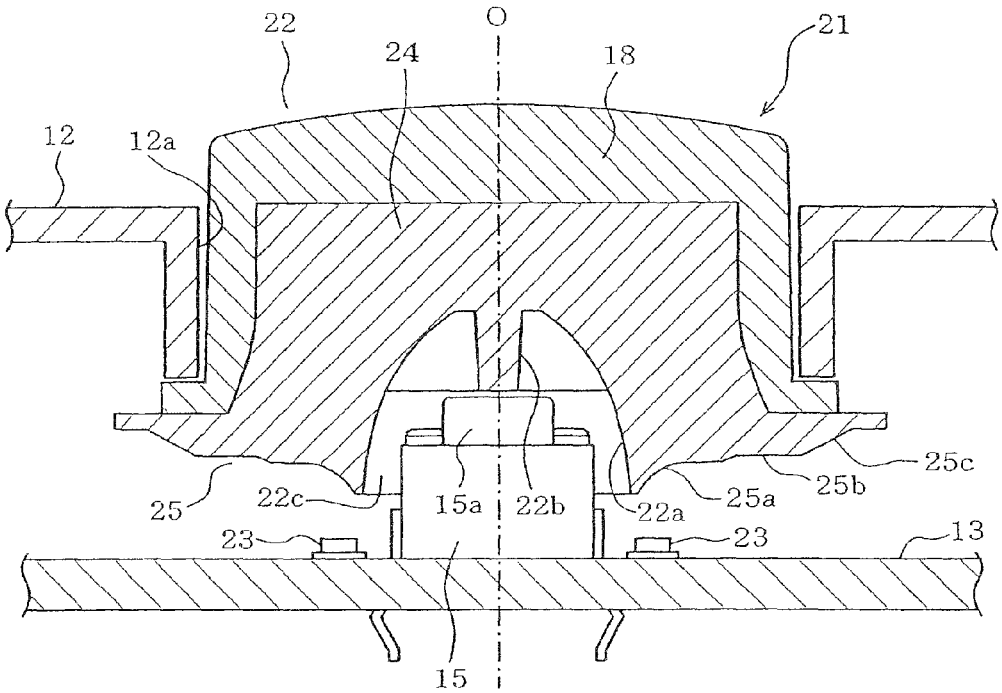
FIG. 8A is a view similar to FIG. 2A, showing the push button switch device of a second example.
Figure 8B:
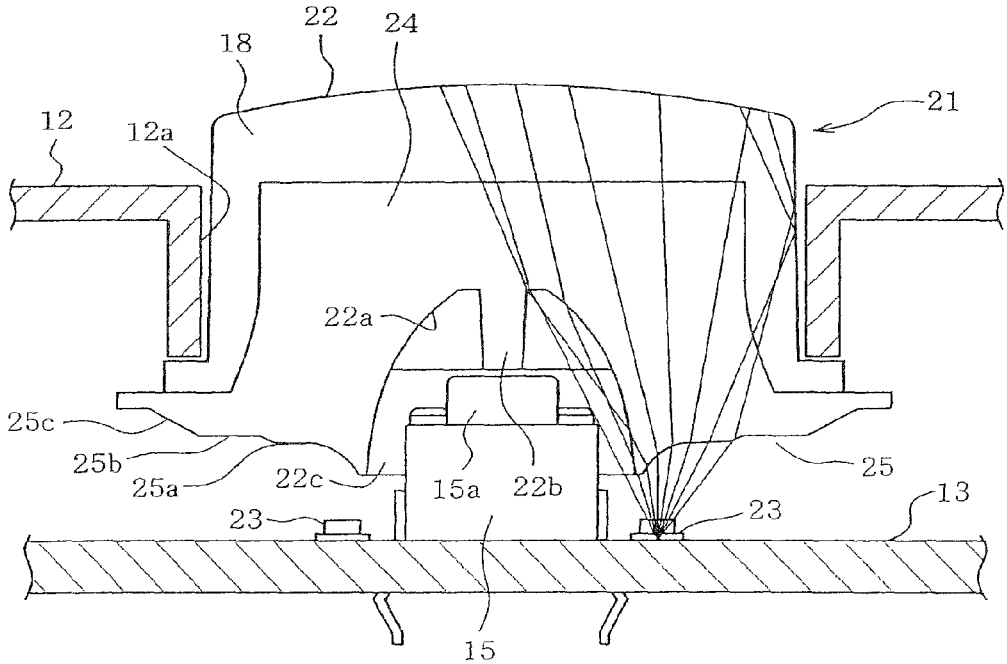
FIG. 8B is a view similar to FIG. 2B, showing light emitted from LED to be incident on the push button member in the second example.
Figure 9:
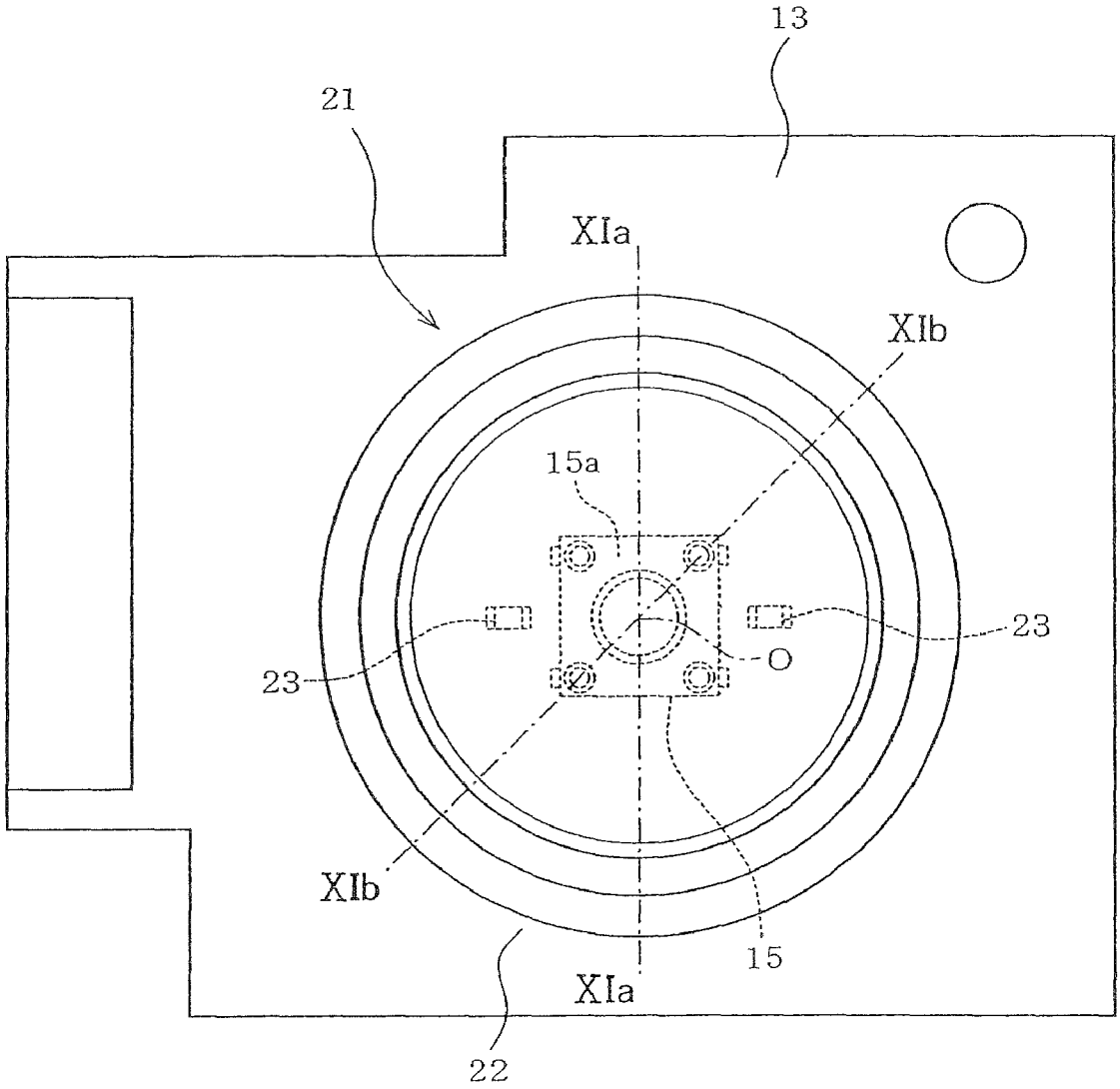
FIG. 9 is a plan view of the push button switch device with the cover being eliminated.
Figure 10:
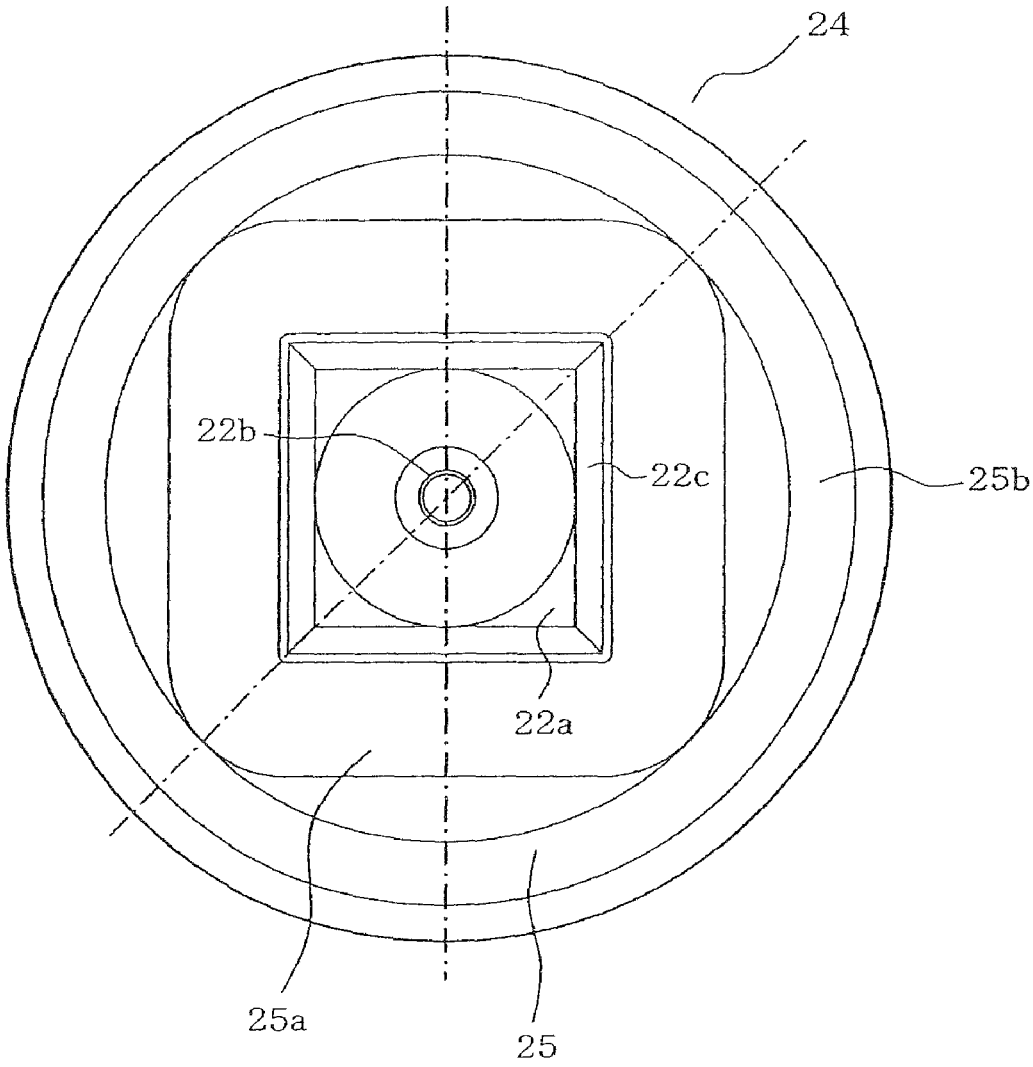
FIG. 10 is a bottom view of the push button member.
Figure 11A:
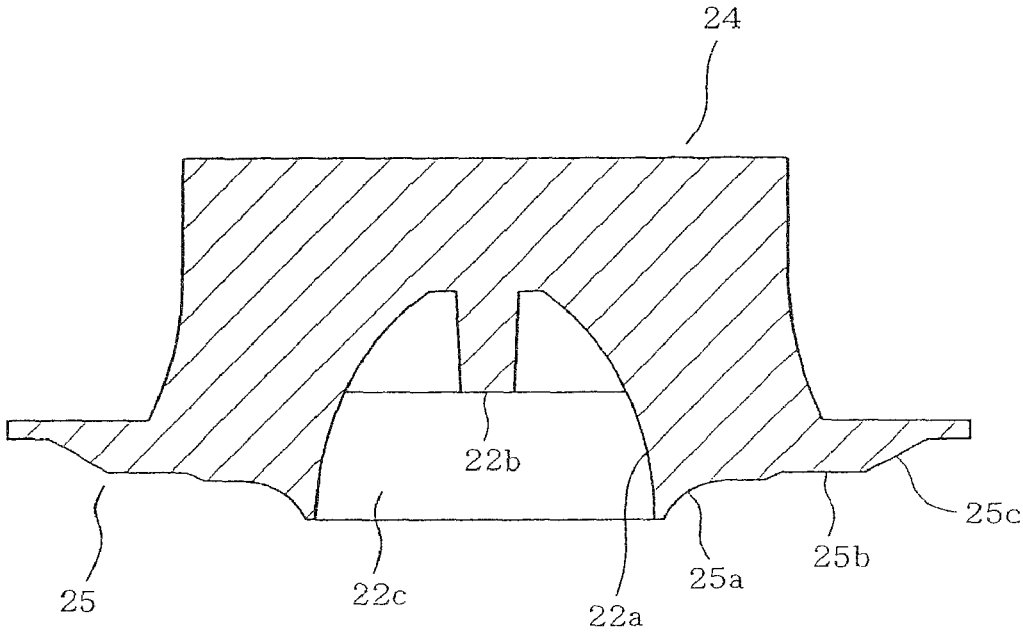
FIGS. 11A and 11B are longitudinal sections of the transparent member taken along lines XIa-XIa and XIb-XIb in FIG. 9 respectively.
Figure 11B:
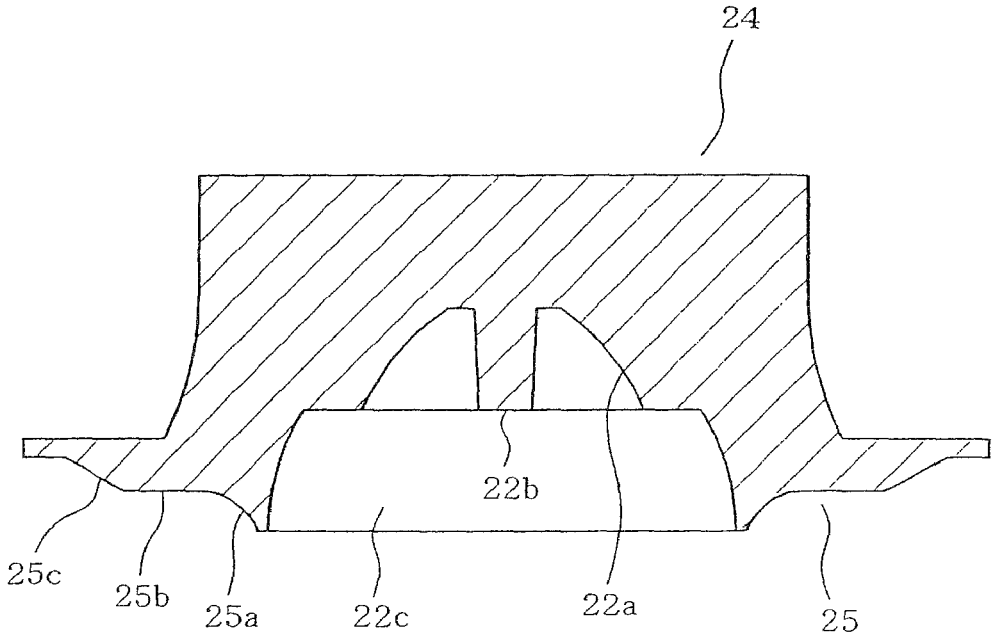
Figure 12:
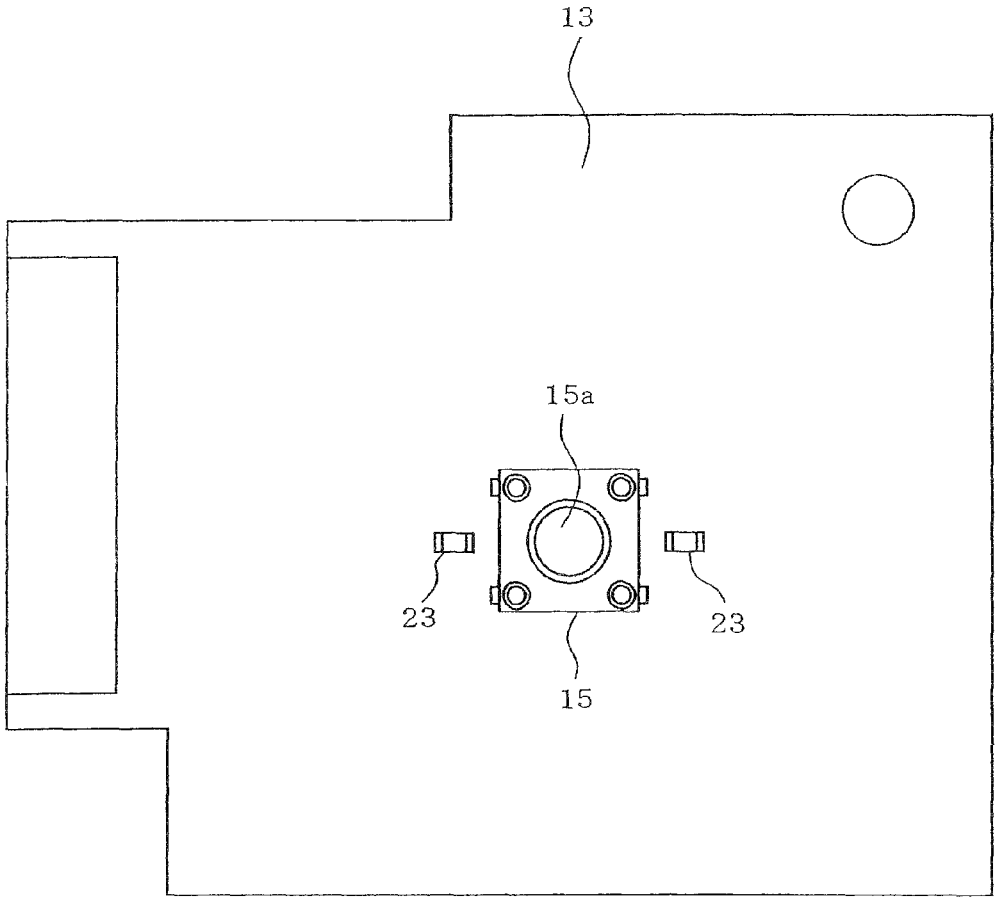
FIG. 12 is a plan view of the circuit board.

The push button switch device 21 includes a push button member 22 provided in the opening 12*a* of the cover 12, a switching element 15 mounted on the circuit board 13, such as a "tact switch" (a registered trademark), and a plurality of LEDs 23 serving as light sources as shown in FIGS. 8A and 8B. Each LED 23 comprises a red LED. In the second example, two LEDs 23 are located on the right and left of the switching element 15 respectively as shown in FIGS. 9 and 12. The push button member 22 comprises a transparent member 24 further comprising a transparent plastic molding and a cap member 18 further comprising an opalescent plastic molding and serving as a light scattering member, as shown in FIGS. 8A and 8B. The transparent member 24 and the cap member 18 are joined closely to each other and the push button member 22 is formed into the shape of a shallow hat. The push button member 22 has a recess 22*a* which is formed in a central rear surface thereof (or of the transparent member 24) as the push button member 14 in the first example. A push rod 22*b* is also formed so as to protrude along a central axis line O to operate the operating portion 15*a* of the switching element 15. The recess 22*a* includes a substantially square hole that becomes wider as a part thereof located lower than a vertically middle thereof goes downward and a circular recess that is tapered so as to be narrowed as the circular recess goes upward from the upwardly middle part thereof and that is continuous to the square hole. The surface texturing is applied to an inner surface of the square hole of the recess 22*a* so that the inner surface serves as a light scattering surface 22*c* which scatters light. The square hole is arranged so as to cover a substantially square switching element 15, whereupon corners of the square hole correspond to corners of the switching element 15, as viewed in a plan view.

The push button member 22 (or the transparent member 24) has a rear surface including a part that is located outside the recess 22*a* and serves as an incidence plane 25 formed so that light from the LEDs 23 is incident thereon, as shown in FIGS. 8A, 8B, 11A and 11B. The incidence plane 25 is formed with a concave curved surface 25*a* that is located so as to substantially face the LEDs 16 and has an arc-shaped section, as in the first example. The incidence plane 25 also has a substantially horizontal plane 25*b* which is located outside the concave curved surface 19*a* and is continuous to the concave curved surface 25*a*. The incidence plane 25 further includes an inclined surface 25*c* which is located outside the horizontal plane 25*b* and is inclined more gently as the plane 25*b* goes toward an outer circumference thereof.

The above-described incidence surface 25 is provided with the concave curved surface 25*a* that is located so as to substantially face the LEDs 23 as in the first example. As a result, light incident on the concave curved surface 25*a* can be scattered onto the whole push button member 22 (the transparent member 24). Furthermore, light incident on the surface 25*b* outside the concave curved surface 25*a* can be refracted so as to go toward the central part of the push button member 22. Moreover, the incidence surface 25 as a whole is formed into such an inclined surface as to be spaced upwardly farther away from the light sources as the incidence surface 25 goes to the outer part thereof. As a result, light incident on the incidence surface 19 can be refracted toward the central region. Accordingly, the light incident on the incidence surface 25 can be refracted in such a direction that the light goes to the central part of the push button member 22, whereby the light can be concentrated on the central region of the push button member 22 where the brightness tends to be reduced.

In the structure of the second example, the operation axis of the switching element 15 substantially corresponds with the central axis O of the push button member 22. Consequently, a good operational feeling can be obtained when the user depresses the push button member 22. Furthermore, the light can be scattered by the opalescent cap member 18 mounted on the surface of the push button member 22, whereupon the user can view the push button member 22 illuminated brightly from any direction. Still furthermore, the light scattering surface 22*c* is provided on the inner surface of the recess 22*a*. This can suppress an unintended total reflection of light on the inner surface of the recess 14*a*, whereupon a reduction in the brightness can be suppressed in the central surface region of the push button member 22.

Accordingly, the push button member 22 can also provide a good operation feeling in the second example. And the nonuniformity in the brightness of the surface of the push button member 22 can be overcome by the improvement in the configuration of the incidence surface 25 of the push button member 22, and the like without increase in the number of components. Thus, the surface of the push button member 22 can be illuminated uniformly.

FIGS. 13A to 15B illustrate a third example. A push button switch device 31 of the third example includes a push button member 32, the switching element 15 mounted on the circuit board 13, such as a "tact switch" (a registered trademark), and plural (four) LEDs 16 serving as light sources. The push button member 32 as a whole is formed into a horizontally long block having flanges formed on horizontally opposite lower ends thereof. The push button member 32 is mounted in a square opening of a front cover 33 of the sewing machine body so as to be depressible.

Figure 13A:
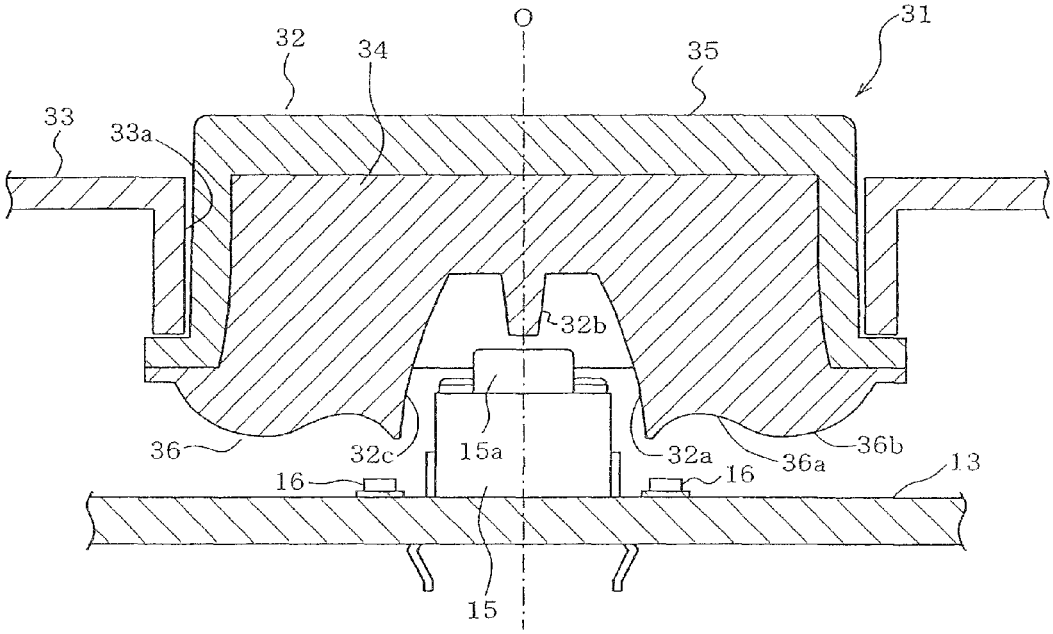
FIG. 13A is a view similar to FIG. 2A, showing the push button switch device of a third example.
Figure 13B:
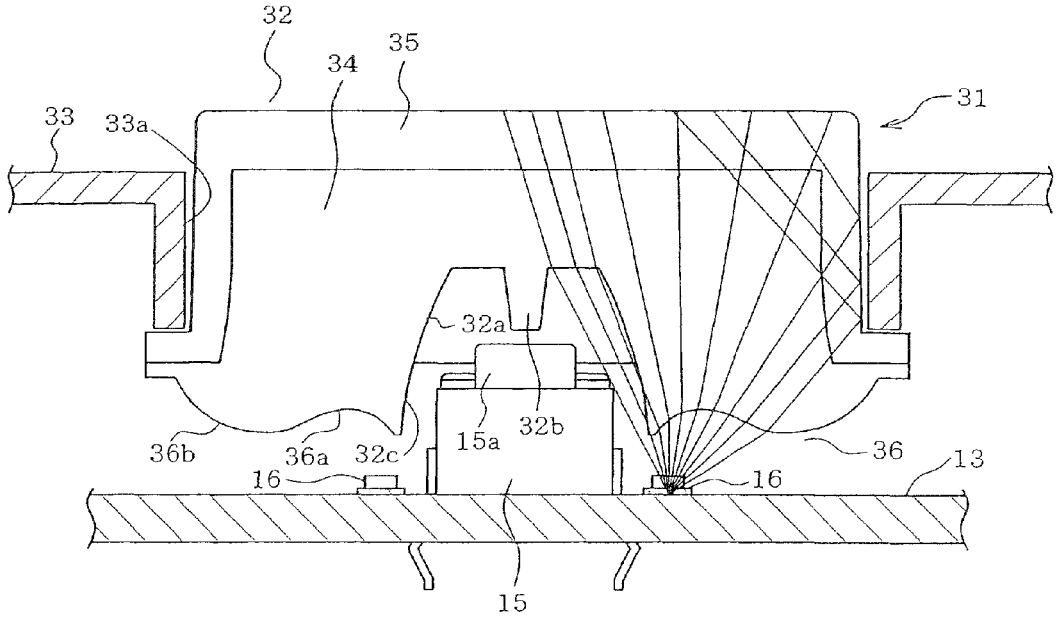
FIG. 13B is a view similar to FIG. 2B, showing light emitted from LED to be incident on the push button member in the third example.
Figure 14:
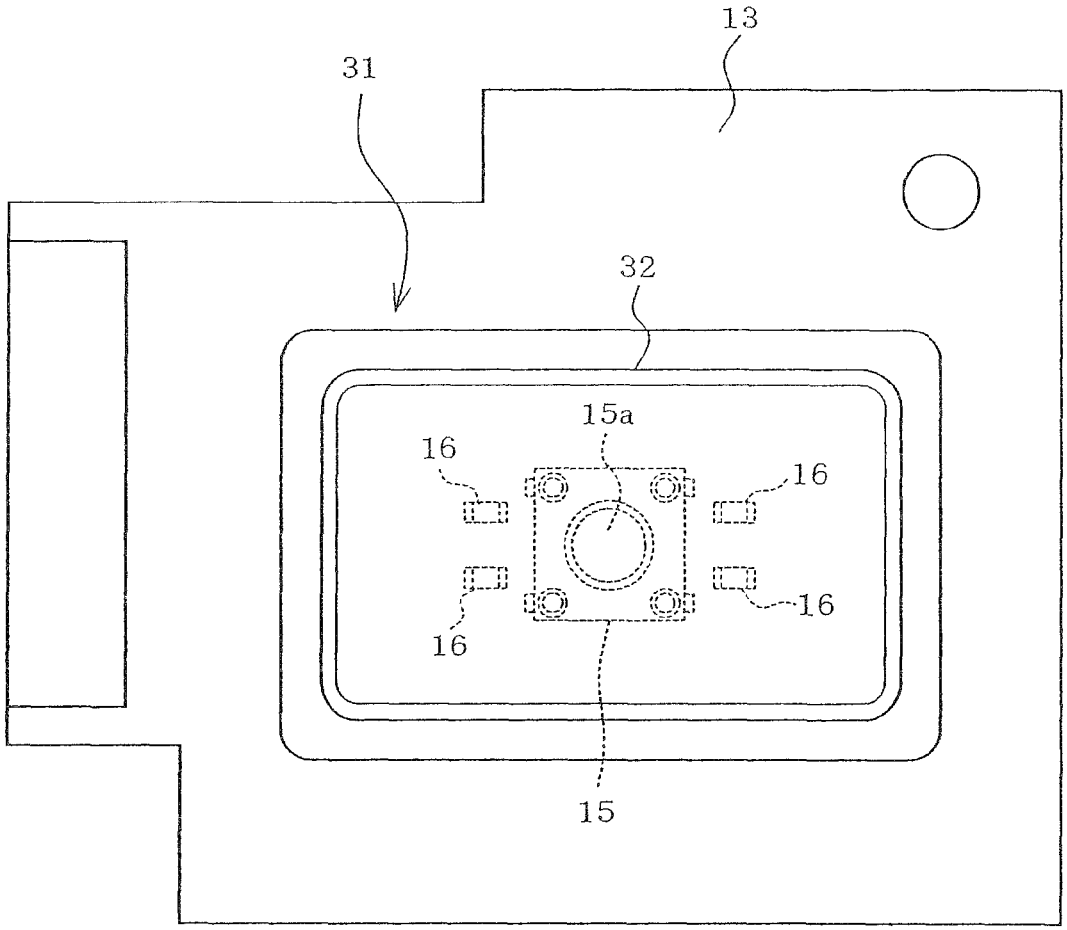
FIG. 14 is a plan view of the push button switch device with the cover being eliminated.
Figure 15A:
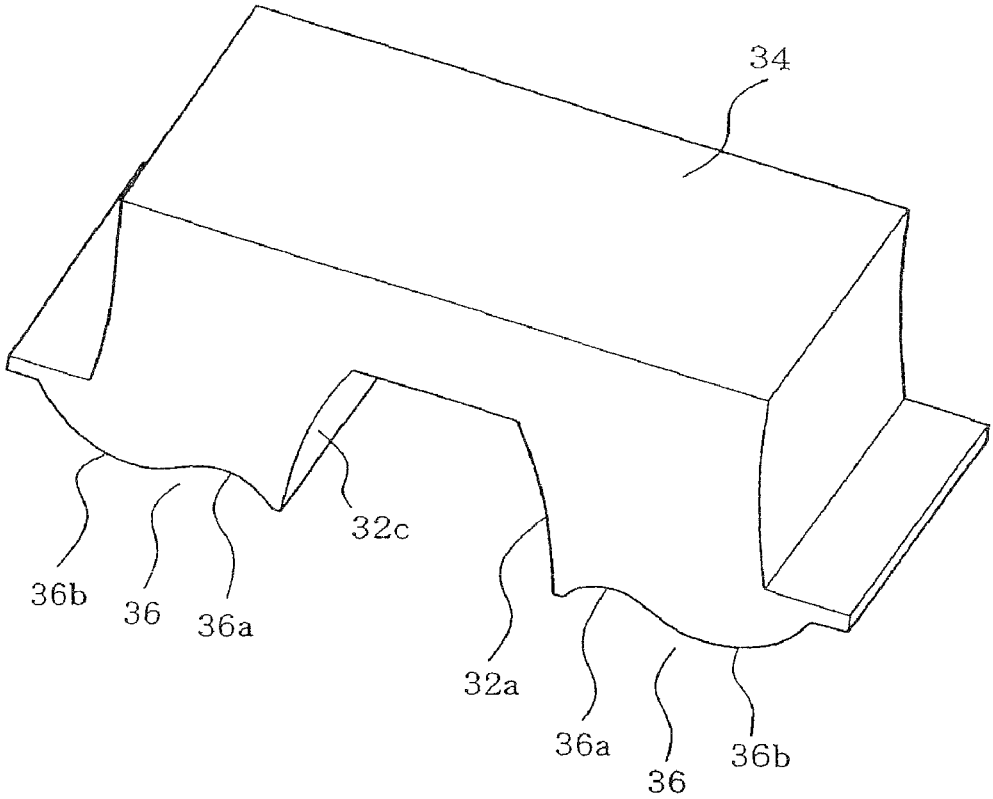
FIGS. 15A and 15B are perspective and bottom views of the transparent member respectively.
Figure 15B:
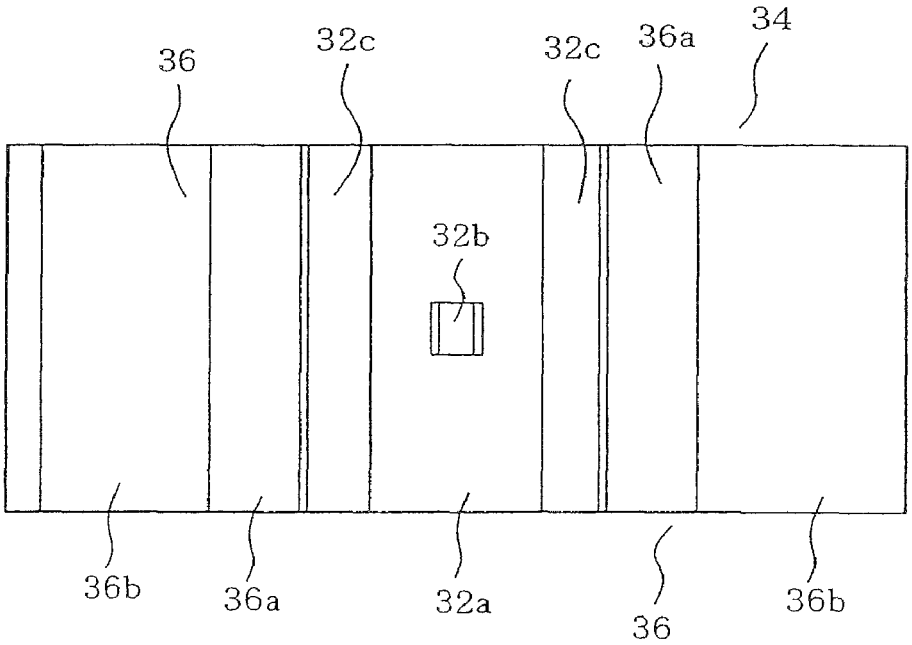

The push button member 33 comprises a transparent member 34 further comprising a transparent plastic molding and a cap member 35 further comprising an opalescent plastic molding and serving as a light scattering member, as shown in FIGS. 13A and 13B. The transparent member 34 and the cap member 35 are joined closely to each other. The cap member 35 has an open underside and is formed into the shape of a rectangular cap elongated in the up-down direction. The cap member 35 is disposed so as to cover the transparent member 34 with close adherence to the upper surface and the outer peripheral surface (four sides) of the latter member 34.

The transparent member 34 as a whole is formed into the shape of a rectangular block slightly elongated in the right-left direction as shown in FIGS. 13A, 13B, 15A and 15*b*. The transparent member 34 has a recess 32*a* formed in the central part of the rear thereof with respect to the right-left direction. The recess 32*a* is tapered upward so as to become narrower as the recess 32*a* goes upward as viewed in the front-rear direction. The recess 32*a* extends in the front-rear direction so as to open at front and rear surfaces of the transparent member 34.

The transparent member 34 has a depressing rod 32*b* formed integrally so as to protrude downward from the bottom of the recess 32*a* or extend along the central axis line O. The depressing rod 32*b* is provided for actuating the operating portion 15*a* of the switching element 32*a*. The depressing rod 32*b* extends along the central axis line O of the push button member 32 as shown in FIGS. 13A and 13B, whereupon the central axis line O corresponds substantially with an operation axis of the switching element 15. Furthermore, the lower half of the inner circumferential surface of the recess 32*a* has a number of convexities and concavities formed by surface texturing. The inner circumferential surface processed by the surface texturing serves as a light scattering surface 32*c* which scatters light.

The rear surface of the push button member 32 (or of the transparent member 34) includes a part outside the recess 32*a* (right and left sides) serves as an incidence surface 36 formed so that light from the LEDs 16 is incident on the transparent member 34. The incidence surface 36 is formed with two concave curved surfaces 36*a* that are located so as to substantially face the LEDs 16 or on the right and left of the recess 32*a* respectively. Each concave curved surface 36*a* extends in the entire dimension of the rear surface of the transparent member 34 in the front-rear direction and has an arc-shaped (arcuate) section extending in the right-left direction.

The incidence surface 36 also has two convex curved surfaces 36*b* located outside the concave curved surfaces 36*a* respectively or on the right of one of the concave curved surfaces 36*a* and on the left of the other concave curved surface 36*a* respectively. The convex curved surfaces 36*b* are continuous to the concave curved surface 36*a* respectively. Each convex curved surface 36*b* has a curvature reverse to the concave curved surface 36*a* and is formed so as to have an arc-shaped (arcuate) section extending in the front-rear direction. Additionally, in the third example, the incidence surface 19 is also formed into such an inclined surface that the incidence surface 36 as a whole is spaced farther upwardly away from the LEDs 16 as the incidence surface 36 goes outward (toward the right and left sides from the central part).

In the above-described push button switch device 31, the light emitted from the LEDs 16 is incident on the concave curved surfaces 36*a* formed on the incidence surface 36 of the push button member 32 as in the first example. The light incident on the concave curved surfaces 36*a* can be scattered onto the whole push button member 32 (the transparent member 34). Furthermore, light incident on the convex curbed surface 36*b* outside the concave curved surface 36*a* can be refracted in such a direction that the light goes toward the central part of the push button member 32. Moreover, since the incidence surface 36 as a whole is formed into an inclined shape, light incident on the incidence surface 36 can be refracted toward the central region of the push button member 32 where the brightness tends to be reduced.

In the structure of the third example, too, the operation axis of the switching element 15 substantially corresponds with the central axis O of the push button member 32. Consequently, a good operational feeling can be obtained when the user depresses the push button member 32. Furthermore, the light can be scattered by the opalescent cap member 35 mounted on the surface of the push button member 32, whereupon the user can view the push button member 32 bright with light from any direction. Still furthermore, the light scattering surface 32*c* is provided on the inner surface of the recess 32*a*. This can suppress an unintended total reflection of light on the inner surface of the recess 32*a*, whereupon a reduction in the brightness can be suppressed in the central surface region of the push button member 32.

Accordingly, the push button member 32 can also provide a good operation feeling in the third example. And the non-uniformity in the brightness of the surface of the push button member 32 can be overcome by the improvement in the configuration of the incidence surface 36 of the push button member 32, and the like without increase in the number of components. Thus, the surface of the push button member 32 can be illuminated uniformly.

The disclosure should not be limited by the foregoing examples described with reference to the accompanying drawings. The examples may be expanded or modified in various ways. Although the opalescent cap member 18 or 35 is provided as the light scattering member on the surface of the push button member in each of the foregoing examples, the surface texturing may be applied to the surface of the push button member made from a translucent material or a discrete scattering sheet may be affixed to the surface of the push button member. Furthermore, two or four LEDs serving as the light sources are disposed on the right and left of the switching element in each foregoing example. However, for example, four or more LEDs may be disposed on the right and left and in front and back of the switching element. Thus, the number and arrangement of the LEDs may be modified in various ways.

A light-shielding material may be printed on the surface of the push button member so that an intended use of the push button is presented to the user. Furthermore, although the push button switch device is applied to the start/stop switch of the sewing machine in each foregoing example, the push button switch device may be applied to another switch of the sewing machine, such as a thread-cutting switch or a back stitch switch, or to various types of devices, equipment other than the sewing machine or the like. The light scattering surface provided on the inner circumferential surface of the rear of the push button member may or may not be provided. Additionally, various changes may be applied to the whole shape of the push button member, the material of the transparent member, the shape of the incidence plane, the type of light source (color) or the like.

The foregoing description and drawings are merely illustrative of the principles of the present disclosure and are not to be construed in a limiting sense. Various changes and modifications will become apparent to those of ordinary skill in the art. All such changes and modifications are seen to fall within the scope of the disclosure as defined by the appended claims.

What is claimed is:

1. A push button switch device which is provided on an equipment body, comprising:

a push button member which is disposed on a cover constituting an outer surface of the equipment body so as to be depressible, the push button member being configured to be light-transmissible and having an outer surface and a rear surface;

a switching element provided behind the push button member so that an operation axis thereof substantially corresponds with a central axis of the push button member;

a plurality of light sources which is disposed around the switching element to illuminate the outer surface of the push button member, the light sources being operated by the push button member; and an incidence surface which is provided on the rear surface of the push button member so that light from the light sources is incident thereon, the incidence surface including a concave curved surface that is located so as to substantially face the light sources and a convex curved surface that is located outside the concave curved surface and is continuous to the concave curved surface, wherein the push button member has a recess which is formed in a central rear surface so as to be located inside the incidence surface and a light scattering surface which is provided on an inner surface of the recess so as to scatter light.

2. The push button switch device according to claim 1, wherein the push button member includes a transparent member constituting a rear surface of the push button member including the incidence surface and a light scattering member which scatters light through the transparent member to at least an outer surface of the push button member.

3. The push button switch device according to claim 1, wherein the incidence surface is formed into such an inclined surface that an outer part thereof is spaced farther away from the light sources.

4. The push button switch device according to claim 3, wherein the push button member includes a transparent member constituting a rear surface of the push button member including the incidence surface and a light scattering member which scatters light through the transparent member to at least an outer surface of the push button member.

5. A sewing machine comprising:

a sewing machine body; and a push button switch device provided on the sewing machine body and including:

a push button member which is disposed on a cover constituting an outer surface of the equipment body so as to be depressible, the push button member being configured to be light-transmissible and having an outer surface and a rear surface;

a switching element provided behind the push button member so that an operation axis thereof substantially corresponds with a central axis of the push button member;

a plurality of light sources which is disposed around the switching element to illuminate the outer surface of the push button member, the light sources being operated by the push button member; and an incidence surface which is provided on the rear surface of the push button member so that light from the light sources is incident thereon, the incidence surface including a concave curved surface that is located so as to substantially face the light sources and a convex curved surface that is located outside the concave curved surface and is continuous to the concave curved surface, wherein the push button member has a recess which is formed in a central rear surface so as to be located inside the incidence surface and a light scattering surface which is provided on an inner surface of the recess so as to scatter light.

6. The sewing machine according to claim 5, wherein the push button member includes a transparent member constituting a rear surface of the push button member including the incidence surface and a light scattering member which scatters light through the transparent member to at least an outer surface of the push button member.

7. The sewing machine according to claim 5, wherein the incidence surface is formed into such an inclined surface that an outer part thereof is spaced farther away from the light sources.

8. The sewing machine according to claim 7, wherein the push button member includes a transparent member constituting a rear surface of the push button member including the incidence surface and a light scattering member which scatters light through the transparent member to at least an outer surface of the push button member.

* * * * *